United States Patent [19]

Rese

[11] Patent Number: 4,828,185

[45] Date of Patent: May 9, 1989

[54] ELECTROSTATIC POWDER SPRAY GUN

[75] Inventor: Arkadijus Rese, Trübbach, Switzerland

[73] Assignee: Wagner International AG, Switzerland

[21] Appl. No.: 35,399

[22] Filed: Apr. 7, 1987

[30] Foreign Application Priority Data

Apr. 7, 1986 [DE] Fed. Rep. of Germany ..... 3611577

[51] Int. Cl.[4] ..... B05B 7/06; B05B 5/02

[52] U.S. Cl. ..... 239/698; 239/705; 239/707; 239/300; 239/526; 239/364

[58] Field of Search ..... 239/698, 697, 704, 705, 239/290, 300, 417.3, 424, 654, 525, 526, 325, 506, 513, 514, 368, 364, 371, 528, 361/226–228

[56] References Cited

U.S. PATENT DOCUMENTS

| | | | |
|---|---|---|---|
| 2,904,262 | 9/1959 | Peeps | 239/526 X |
| 3,448,925 | 6/1969 | Cross | 239/698 |
| 3,608,823 | 9/1971 | Buschor | 361/227 X |
| 3,977,607 | 8/1976 | Kobayashi et al. | 239/697 X |
| 4,380,320 | 4/1983 | Hollstein et al. | 239/697 |
| 4,659,019 | 4/1987 | Talacko | 239/705 X |

FOREIGN PATENT DOCUMENTS

| | | | |
|---|---|---|---|
| 2022088 | 12/1971 | Fed. Rep. of Germany | 239/698 |
| 952357 | 8/1982 | U.S.S.R. | 239/705 |

*Primary Examiner*—Andres Kashnikow
*Assistant Examiner*—Kevin P. Weldon
*Attorney, Agent, or Firm*—Hill, Van Santen, Steadman & Simpson

[57] ABSTRACT

An electrostatic powder spray gun comprises a powder channel for a powder-air mixture to be sprayed, the powder channel extending through a pistol tube and discharging axially forward at the forward end of the gun through an annular opening which is coaxial with the longitudinal axis of the pistol tube. An auxiliary air line extends through the pistol tube and discharges at the forward end and is constructed in such a manner that the auxiliary air line discharges axially forward as an annular opening coaxial with the annular powder opening, in particular radially and slightly in front of the annular powder opening. An air deflecting member is arranged in front of the auxiliary air annular opening and is seated at the free end of a rod which extends centrally through the pistol tube and is axially displaceable therein. The rod is mechanically coupled to the trigger of the spray gun so that the air deflecting member can be adjusted from the trigger.

12 Claims, 5 Drawing Sheets

ELECTROSTATIC POWDER SPRAY GUN

BACKGROUND OF THE INVENTION

1. Field of the Invention

The present invention relates to an electrostatic powder spray gun of the type which comprises a gun body having a handle on a trigger as well as connections for compressed air and high voltage, a pistol tube secured to the pistol body and an electrode located at the forward end of the pistol tube which is connected to the high-voltage terminal by way of an electrical line extending through the pistol tube and further comprising a powder channel for the powder-air mixture to be sprayed which extends through the pistol tube and discharges axially forward at the forward end thereof as an annular opening coaxial with the longitudinal axis of the pistol tube, and further comprising an auxiliary air line connected to the compressed air connection and extending through the pistol tube and discharging at the forward end thereof.

2. Description of the Prior Art

As principle components, electrostatic powder spray guns comprise a pistol tube from whose mouth a powder-air mixture is output towards the front, and also comprises an electrode arranged in the region of the mouth of the pistol tube and connected to high voltage. In order to be able to influence the shape of the powder jet, it is not only known, but standard, to arrange what is referred to as an impact plate at a defined distance in front of the mouth of the pistol tube, the impact plate usually being mounted at a rod centrally extending through the pistol tube, wherewith the powder jet can then more or less expand to form a powder cloud dependent on the size, shape and distance of the impact plate. It is also known to provide an adjustment structure for the distance of the impact plate from the mouth of the pistol tube, for example the mounting rod may be secured in the pistol body in a screwable manner. One disadvantage of these known powder impact plates is that special manipulations, for example turning a wing nut, are required for adjustment, whereby the adjustment can usually not be carried out during the spraying process, and that the impact plate, even given maximum distance from the mouth of the pistol tube, expands the powder jet, even if not all too greatly, i.e. one does not succeed in producing a focused power jet as is frequently desirable when coating hollow spaces. It is also known to employ auxiliary air jets instead of these mechanical impact plates, in particular in such a manner that the pistol tube is centrally penetrated by a compressed air line ending at a considerable distance in front of the mouth of the pistol tube, this air line being closed at its forward end and comprising discharge bores for the compressed air which are directed obliquely to the rear. The auxiliary air jets emerging from these bores decelerate the powder jet and expand it, i.e. act, so to speak, as a pneumatic impact plate. Here, also, however, special manipulations are required for adjusting the spacing of the bores from the mouth of the pistol tube for the purpose of modifying the shape of the powder cloud and are also required for complete shut-off of the auxiliary air.

SUMMARY OF THE INVENTION

It is therefore an object of the present invention to provide an electrostatic powder spray gun of the type set forth above in which an infinitely variable adjustment is provided between a focused powder jet and a powder cloud having a considerable, radial diameter without special manipulations and that such adjustment is possible during a spraying operation.

The above object is achieved, according to the present invention in an electrostatic powder spray gun of the type generally set forth above which is particularly characterized in that the auxiliary air line discharges axially forward as an annular opening coaxial with the annular powder opening, in particular radially within an axis slightly in front of the annular powder opening, and in that an air deflecting member is arranged in front of the auxiliary air annular opening, the air deflecting member being seated at the free end of a rod centrally extending to the pistol tube and seated axially displaceable therein and mechanically coupled to the trigger.

According to the invention, therefore, the expansion of the emerging powder jet occurs on the basis of auxiliary compressed air whose influence on the powder jet is controlled by an air deflecting member which can, in turn, be adjusted by the trigger of the powder spray gun. This air deflecting member is capable of controlling the auxiliary compressed air between full exit of the auxiliary compressed air and full blockage thereof by way of which all possibilities from the large-dimensioned powder cloud down to the focused powder jet are established, in particular simply in that the operator pulls the trigger effecting the turn-on or, respectively, turn-off of the spraying process to a greater or lesser degree. A maximum adjustment possibility is therefore achieved simultaneously with the simplest possible manipulation.

According to another particular feature of the invention, the trigger does not effect any displacement of the air deflecting member over a first sub-range of its pivoting path, only the turn-on or turn-off events for high voltage, compressed air and powder feed occurring in this first sub-region.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
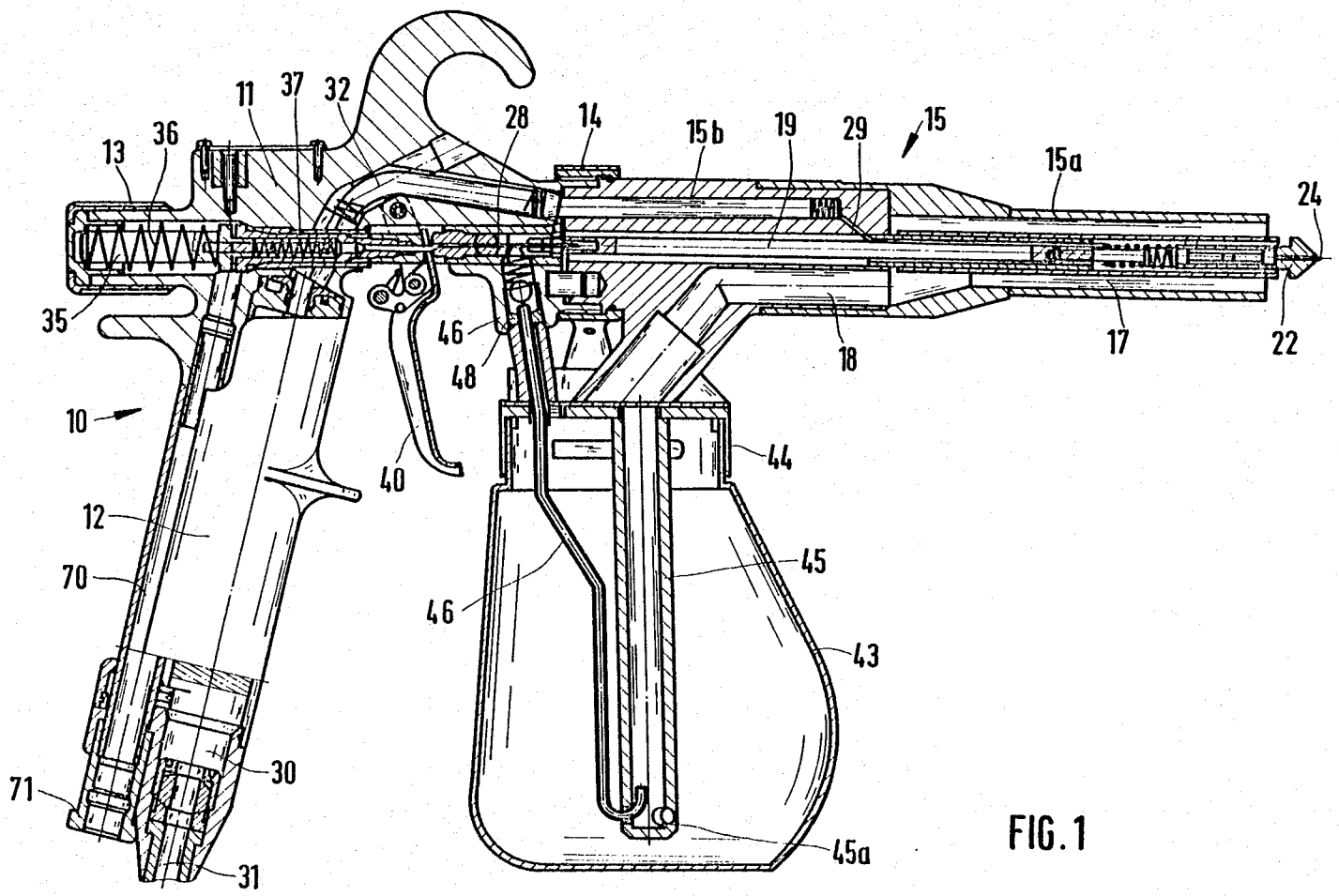
FIG. 1 is a longitudinal elevation, shown partially in section, of a powder gun constructed in accordance with the present invention.

The powder spray gun illustrated in FIG. 1 comprises a base member 10 which has the approximate shape of a "T", whereby a horizontal portion 11 is a tube extending in the spraying direction, whereas a portion 12 extends obliquely and downwardly from the tube 11 and is in the shape of a handle. The horizontal tube 11 is closed by a screw cap 13 at its rear end opposite the spraying direction, whereas its forward end is connected to a pistol tube 15 by way of a plug-tight connection and a union nut 14. A coaxial inner tube 16 (FIG. 2A) extends in the forward region 15*a* of the pistol tube 15, whereby an annular space 17 exists between the inner tube 16 and the forward pistol tube 15*a* and represents the feed for the powder-air mixture to be sprayed, and discharges into the open at the end 17*a* (see FIG. 2A).

Figure 2A:
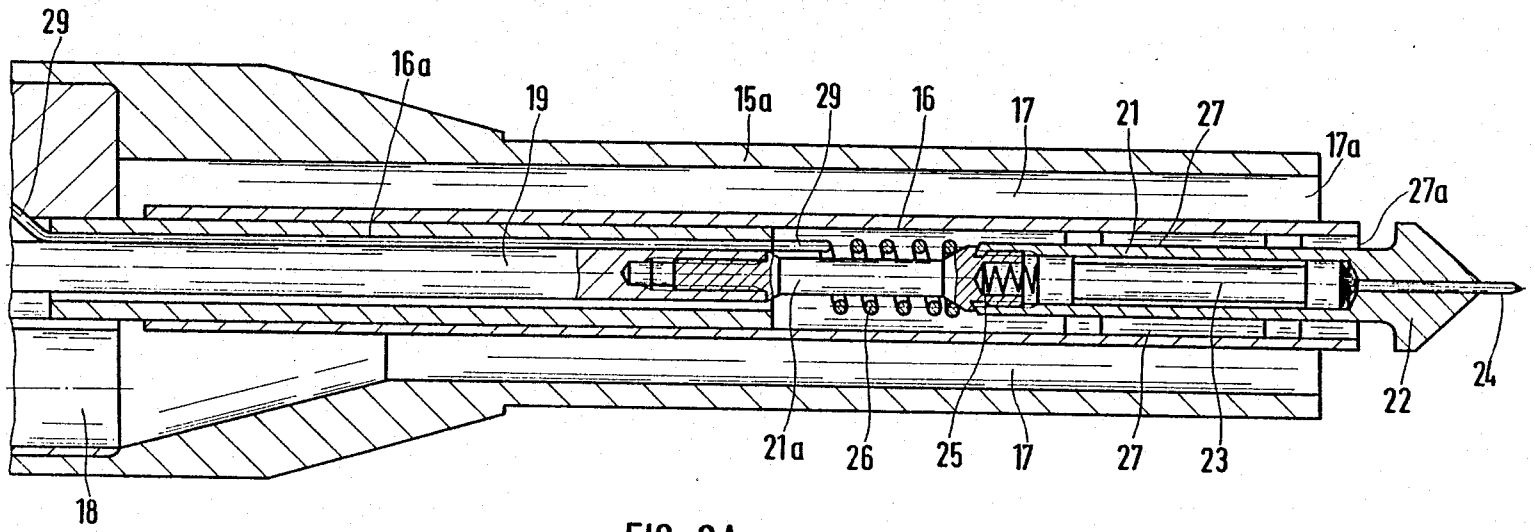
FIGS. 2A and 2B illustrate different portions of FIG. 1 on an enlarged scale.

Referring to FIG. 2A, a channel 18 is provided for the powder-air mixture and extends eccentrically in the rear 15*b* (FIG. 1) of the pistol tube 15, the front side of this channel being in communication with the annular space 17 and comprising a connection at its rear end to a feed source for the powder-air mixture, as shall be set forth in detail below. Upon interposition of a sleeve 16*a*, a rod 19 is displaceable in the rear region of the tube 16, the front end of the rod 19 being screwed into a further rod 21 which has its end projecting from the mouth of the pistol tube 15 as an enlarged section which forms a deflecting member 22. A high-impedance resistor 23 is located in a blind bore 21, a needle electrode 24 centrally extends through the deflecting member 22 and projects therebeyond and is secured to the front end of the high-impedance resistor 23. The rear end of the resistor 23 is supported against the end of the blind bore by way of a spring 25. The rod 21 tapers toward its screw-in end, whereby a coil spring 26 is slipped onto the tapered portion 21*a*. What is essential is that a contiguous annular space 27 passing through the entire pistol tube is present between the front rod 21 and the rear rod 19 and the inner tube 16, the annular space 27 discharging into an opening 27*a* at a distance from the deflecting member 22 and continuing towards the rear of the gun in the form of an annular channel 27*a* into the horizontal portion 11 of the base body 10 up to a seal 28. The aforementioned coil spring 26 represents an electrical contact and is connected, first of all, to the high-impedance resistor by way of the spring 25 and, secondly, to a lead wire 29 which leads through the annular space 27 toward the rear of the tube 11 of the base body 10.

Figure 2B:
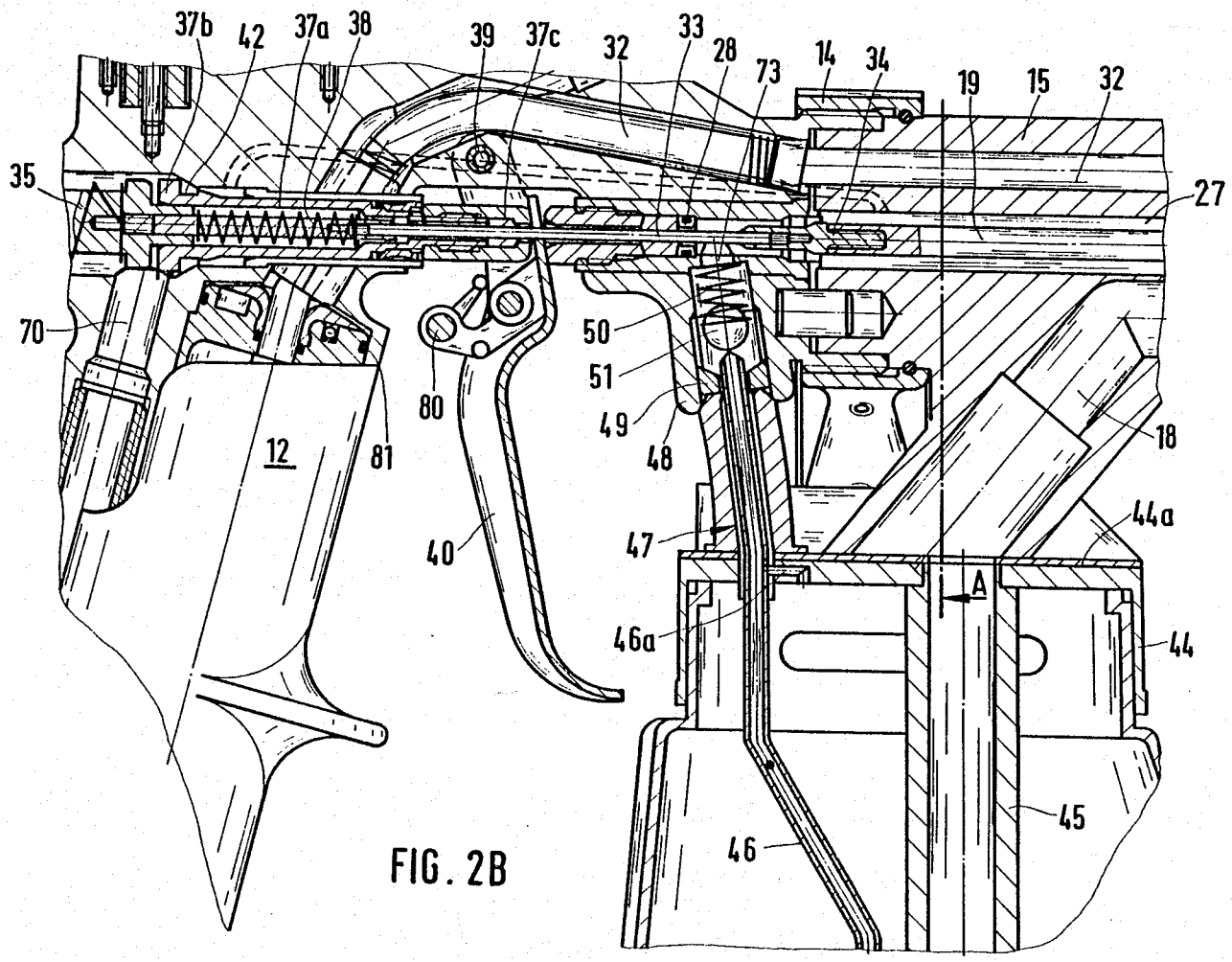

The structure of the base body 10 or, respectively, of the components accommodated therein shall be discussed below, in particular with reference to FIG. 2B. Therefore, a high voltage generator 30 is accommodated in the handle 12, the generator 30 being fed with a high-frequency low voltage by way of a line 31 (see FIG. 1) and transmitting a rectified high-voltage generated therein onto an electrical cable 32 whose free end is electrically connected to the aforementioned conductor 29 of the pistol tube 15. An uninterrupted electrical connection between the output of the high-voltage generator 30 and the needle electrode 24 therefore exists. Furthermore, a rod 33 is seated in an axially displaceable manner in an axial bore of the tube 11, the rod 33 having its forward end connected by way of a coupling 34 to the rear end of the rod 19 and having its rear end screwed into a piston 35 which is stressed in the direction towards the front by a coil spring 36 (see FIG. 3B). Further, the rod 33 is loosely surrounded by a sleeve 37 which is constructed in a multi-part fashion and which is supported against the forward face of the piston 35 by a spring 38 (FIG. 2B). The sleeve 37 comprises a sleeve tube 37*a* having a rear collar 37*b* and a front tensing sleeve 37*c* screwed thereto for prestressing inner and outer seal elements. A trigger 40 is articulated at the pivot 39 and lies, first of all, against the forward face of the sleeve 37 or, respectively, against its tensing sleeve 37*c* and, secondly, lies against an abutment 41. Given the position illustrated in FIG. 2B, the trigger is pressed against the abutment 41 by the action of the spring 38 via the sleeve 37, whereby a slight distance then exists between the sleeve 47 and the piston 45. A further, somewhat larger distance is present between the rear end of the piston 35 and the screwable closing cap 13. What is also significant is that the collar 37*b* of the sleeve 37 has its forward face press against an annular valve seat 42 of the axial bore.

A powder cup 43 is upwardly closed by a screw-tight cover 44. A conveying tube 45 extends vertically down to the proximity of the cup floor and is secured to the screw-tight cover, the conveying tube 45 comprising an intake opening 45*a*. An air tube 46 extends through the cover and is also secured to the cover 44, the air tube 46 projecting upwardly somewhat beyond the cover 45 and discharging into the conveying tube 45 inside the cup 43 adjacent to the opening 45*a*. The upper end of the air tube 46 projecting beyond the cover 44, together with its protective sleeve 47, is plugged into a connection nipple 48 at the underside of the tube 11, whereby the nipple 48 comprises an elastic valve seat 49 and a valve ball 51 which is urged against the valve seat by a spring 50. The tip of the inserted air tube 46 thereby presses the valve ball 51 away from the valve seat 49 against the action of the spring 50. Furthermore, a transverse bore 46*a* is provided in the cover 44 and is in communication, first of all, with the air tube 46 and, secondly, with the interior of the powder cup 43.

The mounting of the powder cup 43 to the powder gun advantageously occurs by way of a releasable clamp connection or the like (not shown).

Finally, a line 70 with a connecting nipple 71 for compressed air is provided at the rear side of the handle 12, the discharge thereof into the interior of the gun, however, being closed in the illustrated position, namely by the collar 37*b* of the sleeve 37 which acts as a valve body and presses against the valve seat 42. When, as shall be set forth below, however, the collar 37*b* moves away from the valve seat 42, then an annular space arises between these two parts, the compressed air supplied from the line 70 being capable of penetrating into this annular space. The annular space is in communication with the channel extending essentially parallel to the pistol axis outside of the plane section of the drawing, this channel being connected to the annular space 27 located in front of the seal 28, whereby the annular space 27, as mentioned, first leads through the entire pistol tube 15 to the mouth 27*a* and, secondly, is in communication with the interior of the connecting nipple 48 by way of a channel 73.

The powder gun operates in the following manner. Given the position shown on the drawing, the trigger is not pulled, i.e. the spray gun is in its quiescent condition. The valve composed of the collar 37*b* and the valve seat 42 therefore blocks the compressed air feed and the high voltage is also shut off in that the magnet 80 located at the trigger 40 is at too great a distance from the magnetic switch 81 in the handle 12 which, when actuated, connects the high voltage by way of the conductor 32. When the trigger 40 is then pulled, i.e. pivoted a short distance about its pivot point 39 in a clockwise direction, it pushes the sleeve 37 towards the left against the force of the spring 38 without, however, the collar 37*b* contacting the front face of the piston 35. The result of this displacement, first of all, is that the magnet 80 switches on the high voltage due to its approach to the magnetic switch 81, i.e. an electrically conductive connection from the high-voltage generator 30 via the cable 32, the conductor wire 39, the metal spring 26, the contact spring 25 and the highimpedance resistor 23 to the electrode needle 24 is completed. Secondly, the collar 37*b* of the sleeve 37 lifts off from the valve seat 42 so that compressed air from the line 70 flows into the annular space thereby deriving and flows further to the annular space 27 via the channel (shown by a dot-dash line) and proceeds through the annular space 27 to the mouth 27*a* where it emerges into the open upon deflection by the member 22. At the same time, however, compressed air proceeds from the channel 27 via the bore 73 into the interior of the connecting nipple 48 and proceeds further into the air tube 46, whereby a small portion of the air flows through the cover bore 46*a* into the upper portion of the cup 43 and thereby whirls the powder located therein and the main portion of the air flows out of the mouth of the air tube 46 located within the conveying tube 45 and, on the basis of injector action, intakes air located in the powder cut 43 through the opening 45*a* and upwardly entrains the powder therein into the conveying tube 45. The powder-air mixture streaming upwardly in the conveyor tube 45 then proceeds into the channel 15 and further proceeds into the channel 17 until, finally, it emerges as a spray cloud at the output 17. When the trigger 40 is pulled farther in a clockwise direction, the collar 37*b* of the sleeve 37 is placed against the front face of the piston 35 and presses the latter rearwardly against the force of the spring 36. Therefore, the rod 19 is also shifted towards the left, as are the rod 21 and the member 22 together therewith. This movement of the member 22 closer to the mouth 27*a* of the compressed air output influences the outflow of compressed air. Otherwise, neither the high voltage nor the feed of the powder-air mixture to the mouth 17*a* are influenced by this further pulling of the trigger 40.

Figure 3A:
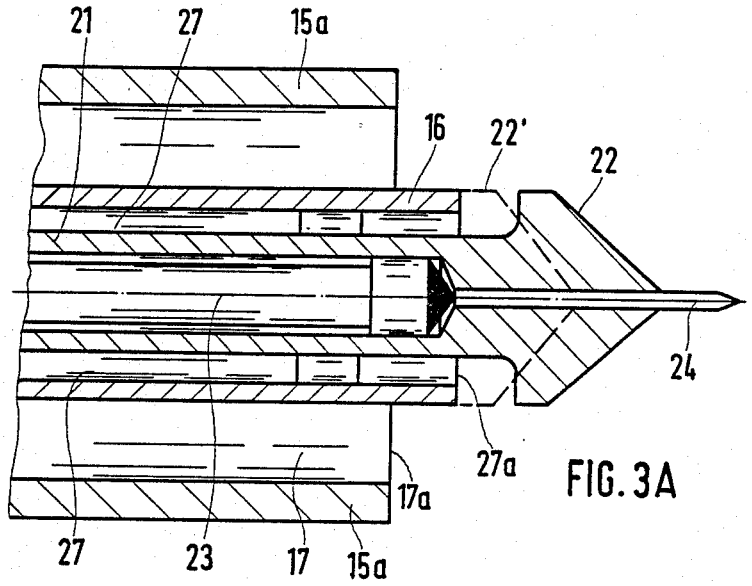
FIGS. 3A and 3B are even more greatly enlarged portions of FIG. 1 for explaining the mode of operation.
Figure 3B:
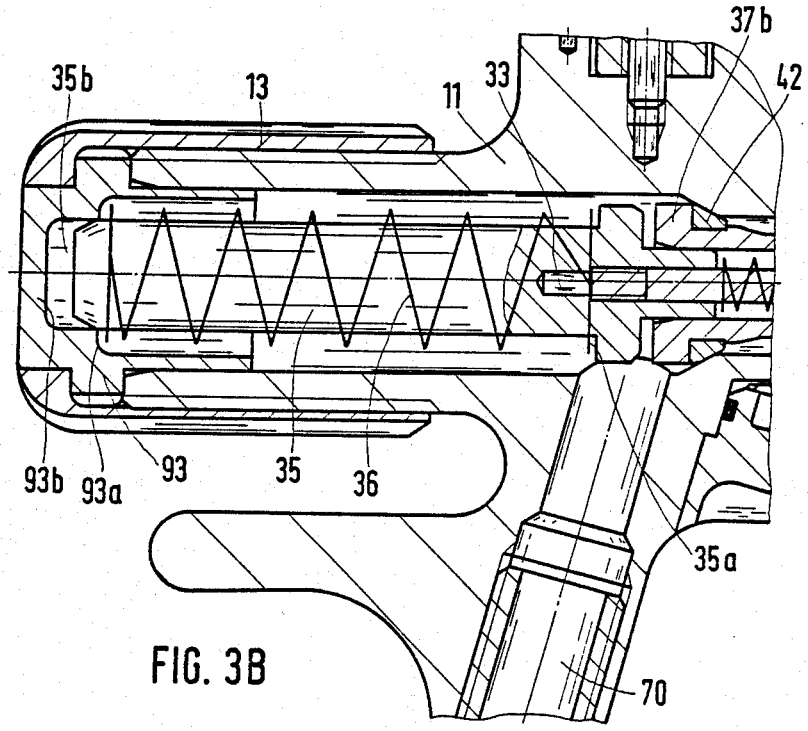

This adjustment of the member 22 proceeding from the trigger 40 shall be set forth in greater detail with reference to FIGS. 3A and 3B. It may be seen from FIG. 3B that the piston spring 36 is engaged and bears against the collar 35*a* of the piston 35 and a constriction 93*a* of the sleeve 93 which is held fast by the screw sleeve 13 and is slidable in the piston space of the gun body 11. As long as the piston 35 is not experiencing any force due to the influence of the sleeve 37, it is therefore located in its right-hand final position fixed by a stop, whereby the member 22 rigidly connected to the piston 35 via the rods 33, 19 and 21 is likewise located in its right-hand final position, this being shown with solid lines in FIG. 3A. Given the aforementioned, further pulling of the trigger 40, however, the collar 37*b* of the sleeve 37 then engages the front face of the piston 35 and pushes the same towards the left, whereby the possible displacement path is equal to the distance between the rear face 35*b* of the piston 35 and the inner end surface 93*b* of the sleeve 93. This distance between the surfaces 35*b* and 93*b*, however, is variable in the simple manner in accordance with FIG. 3*b*, namely by screwing the terminating sleeve 13 holding the sleeve 93. This, however, means that the displacement path of the member 22 (FIG. 3A) is also adjustable in this manner, being displaceable such, if desired, given seating of the surface 35*b* against the surface 93*b*, the member 22 presses against the forward face of the tube 16 and therefore completely closes the discharge opening 27*a* of the auxiliary compressed air line 27. The member 22 is then located in the position 22′ illustrated by broken lines in FIG. 3A. The following operating conditions therefore derive for the functioning of the powder spray gun. When the trigger 40 is pulled rearwardly only a short distance so that the piston 35 is not contacted by the sleeve 37 and therefore remains in its right-hand final forward position, then the compressed air emerging from the annular opening 27*a* is, in fact, radially deflected towards the exterior by the member 22 located relatively far in front of the annular opening 27*a*, but this is done without transmitting a significant portion of its kinetic energy onto the member 22. The radially deflected air is therefore in the position to considerably deflect the powder-air mixture emerging from the annular opening 17*a* in the radial direction, i.e. the powder jet is greatly expanded, and a powder cloud having a considerable diameter occurs. When the trigger 40 is pulled farther back, then the sleeve 37 displaces the piston 35 towards the left so that the member 22 approaches the front edge of the tube 16. The result is that, due to its greater impact against the member 22, the compressed air emerging from the annular opening 27*a* transmits more kinetic energy to the member 22 and, therefore, effects less of an expansion of the powder jet. When the trigger 40 is pulled even farther back, then the member 22 finally arrives in the position shown at 22′ and closes the annular opening 27*a*. Therewith, however, absolutely no expansion of the powder jet emerging from the annular opening 17*a* now occurs. The powder jet therefore comprises a relatively small diameter as desired, for example, for coating hollow spaces. An infinitely variable control of the powder jet can therefore be carried out proceeding from the trigger 40, namely from a powder cloud having a considerable diameter to a comparatively focused powder jet. This control thereby occurs, however, without a mechanical impediment (powder impact plate), exclusively on the basis of the auxiliary compressed air.

Figure 4:
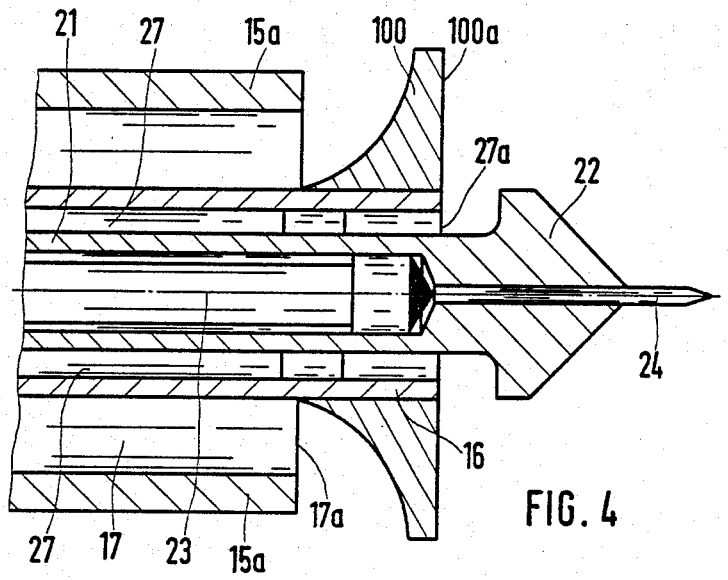
FIGS. 4 and 5 are views similar to FIG. 3A for explaining two modifications of the invention.

FIG. 4 illustrates a modification of the structure in accordance with the present invention, whereby the additional possibility of a mechanical deflection of the powder jet emerging from the annular opening 17*a* is provided. To this end, a powder impact plate 100 having a standard shape is plugged onto the front region of the powder tube 16, the front face 100*a* of the powder impact tube 100 aligning with the front edge of the tube 16 (see FIG. 4) The connection between the impact plate 100 and the tube 16 can occur by way of a threaded connection or by way of a snug fit, by way of which the impact plate 100 can then be put in place or removed at any time or, respectively, can be replaced by an impact plate having some other diameter. The maximum diameter of the member 22 is thereby dimensioned slightly smaller than the outer diameter of the tube 16 in order to therefore be able to easily plug on the impact plate 100 or, respectively, remove the plate. When, during operation of the powder gun of FIG. 4, the trigger 40 is pulled back so that the member 22 completely closes the annular opening 27*a*, then the powder gun works like the known powder guns comprising powder impact plates. Advantageously, however, the trigger 40 will not be entirely pulled back in order to therefore enable an exit of compressed air from the annular opening 27*a*, whereby this compressed air then sees to it that no powder can deposit on the front side 100*a* of the impact plate 100. This compressed air can also lead to a further expansion of the powder cloud.

Figure 5:
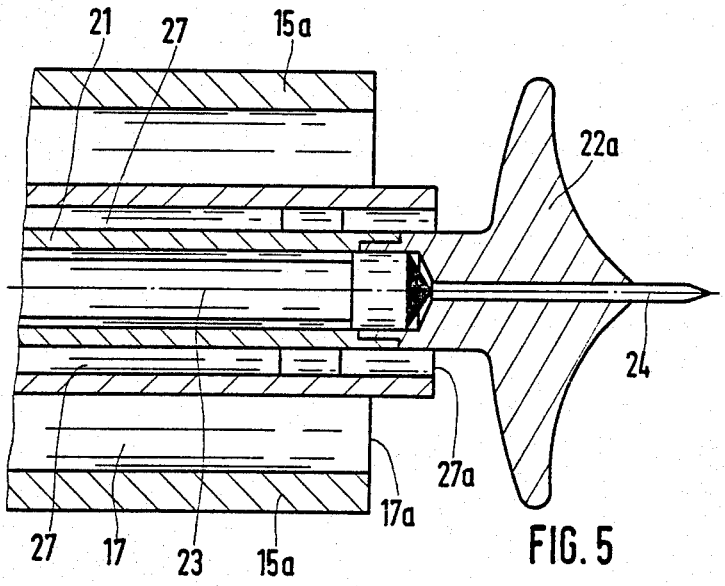

When, in the embodiments of FIGS. 3 and 4, the member 22 comprises a maximum diameter equal to or essentially equal to the outer diameter of the tube 16, i.e. serves as a mere deflecting member for the compressed air, then the deflecting member 22*a* shown in FIG. 5 may be provided and comprises a significantly enlarged diameter which is essentially equal to the outer diameter of the front portion 15*a* of the pistol tube 15. The radial outside region of the member 22*a* therefore extends up to in front of the annular opening 17*a*, and is therefore located in front of the emerging powder jet in the axial direction, similar to standard powder impact plates. Nonetheless, the member 22*a* acts in a different manner. The compressed air emerging from the annular opening 27*a*, in particular, flows radially out as a layer at the rear side of the member 22*a*, so that the powder particles emerging from the annular opening 17*a* do not reach the rear side of the member 22*a* but are already deflected radially before reaching this location, namely to an extremely great degree, so that a powder cloud having a considerable diameter arises. Only when, due to complete pull-back of the trigger 40, the member 22*a* is retracted to such a degree towards the left that it closes the annular opening 27*a* does it act as a standard powder impact plate. The embodiment of FIG. 5 therefore represents, so to speak, a combination of the embodiments of FIGS. 3 and 4. What is also significant is that the member 22*a* is not a mere thickening of the rod 21 but is a separate member which, as may be seen from the drawing, is screwed onto the front end of the rod. There is therefore the interchanging members 22*a* of different size and shape.

Of course, the present invention is not limited to the illustrated exemplary embodiments; rather, numerous modifications of the invention are possible without departing from the spirit and scope of the invention. Therefore, of course, structures constructed in accordance with the present invention can be employed not only given cup powder guns, but it can also be employed in powder guns having a supply of the powder-air mixture proceeding from a remote powder preparation system.

Furthermore, the mechanical connection between the member 22 and the trigger 40 can also be resolved in some other structural manner, for example such that the member 22 beings its pull-back motion immediately upon actuation of the trigger 40.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In an electrostatic powder spray gun of the type which comprises a gun body including a handle and a trigger and connections for compressed air and high voltage, and a pistol tube secured to the gun body including an electrode located at the forward end and which is connected to the high voltage by way of an electrical line extending through the pistol tube and through the handle, and comprising a powder channel including a powder-air opening for a powder-air mixture to be sprayed which extends through the pistol tube and discharges axially forward at the forward end of the pistol tube as an annular opening coaxial with the longitudinal axis of the pistol tube, the improvement compising: an auxiliary air line extending through the pistol tube and discharging at the forward end thereof axially forward as an annular opening coaxial with the annular powder opening and in front of a powder-air opening; an air deflecting member arranged in front of the auxiliary air annular opening; and a rod mounting said deflecting member and extending centrally through said pistol tube and seated axially displaceable therein and coupling said air deflecting member to said trigger for axial displacement and providing a continuously variable spacing between said air deflecting member and said annular opening of said auxiliary air line, wherein said deflecting member includes a rear end; and a piston is coupled to and displaceable by said trigger towards the rear of said spray gun; a spring urges said piston towards the forward end of said spray gun; and said deflecting member is coupled to said piston, and further comprising: a sleeve loosely surrounding said rod between said piston and said trigger, said trigger engaging the forward face of said sleeve; and a further spring engaging the rear end of said sleeve and normally holding said sleeve at a slight distance in front of said forward face of said piston.

2. The improved electrostatic powder spray gun of claim 1 wherein said sleeve comprises a primary member and a clamping sleeve connected thereto and seal elements mounted so as to be clamped by said clamping sleeve.

3. The improved electrostatic powder spray gun of claim 4, comprising: a screw sleeve at the rear end of said spray gun supporting said piston sping, said spring biasing the rear face of the piston forward and said screw sleeve being used to adjust displacement distance of the piston.

4. The improved electrostatic powder spray gun of claim 3, wherein:

said gun body comprises an annular valve seat and said sleeve comprises a rear end constructed as a collar which is stressed against said valve seat by said further spring, whereby the sleeve collar and the valve seat form a compressed air valve actuatable by said trigger.

5. The improved electrostatic powder spray gun of claim 4, wherein:

said rod comprises a plurality of sections which are releasably connected to one another.

6. The improved electrostatic powder spray gun according to claim 5, wherein:

a high-impedance resistor is integrated in the forwardmost portion of said rod; and another spring electrically connecting said rod to said electrode.

7. The improved electrostatic powder spray gun of claim 6, and further comprising:

means for releasably securing said air deflecting member to said forward end of said rod.

8. The improved electrostatic powder spray gun according to claim 7, wherein:

said air deflecting member includes a rear deflecting surface which is seated against the forward end of the auxiliary air line to close the same in response to a fully-retracted trigger.

9. The improved electrostatic powder spray gun of claim 8, wherein:

said air deflecting member comprises a maximum diameter in the radial direction which is essentially identical to the outer diameter of the auxiliary air line.

10. The improved electrostatic powder spray gun of claim 8, wherein:

said air deflecting member comprises a maximum diameter in the radial direction which is essentially identical to the outer diameter of the forward portion of the pistol tube.

11. The improved electrostatic powder spray gun of claim 10, and further comprising:

a powder impact plate detachably secured to the forward portion of the auxiliary air line which projects beyond the annular powder opening.

12. The improved electrostatic powder spray gun of claim 11, wherein:

said power impact plate comprises a forward portion which is aligned with the auxiliary air annular opening in the radial direction.

* * * * *